United States Patent [19]

Monticelli

[11] 4,157,493

[45] Jun. 5, 1979

[54] DELTA $V_{BE}$ GENERATOR CIRCUIT

[75] Inventor: Dennis M. Monticelli, Fremont, Calif.

[73] Assignee: National Semiconductor Corporation, Santa Clara, Calif.

[21] Appl. No.: 830,289

[22] Filed: Sep. 2, 1977

[51] Int. Cl.[2] ..... G05F 1/58

[52] U.S. Cl. ..... 323/9; 323/19

[58] Field of Search ..... 323/19, 1, 4, 9, 68, 323/22 T

[56] References Cited

U.S. PATENT DOCUMENTS

| | | | |
|---|---|---|---|
| 3,887,863 | 6/1975 | Brokaw | 323/19 |
| 4,004,462 | 1/1977 | Dobkin | 323/19 |
| 4,061,959 | 12/1977 | Ahmed | 323/19 |
| 4,071,813 | 1/1978 | Dobkin | 323/19 |

OTHER PUBLICATIONS

*IEEE Journal of Solid State Cks,* vol. SC-8, No. 5, Jun. 1973, pp. 222–226; "A Precision Ref. Voltage Source" by Kuijk.

*Electronic Design* 22, Oct. 24, 1968, pp. 116, 118, "Linear Diff. Temp. Sensor is Accurate & Simple" by Dobratz.

*Primary Examiner*—Gerald Goldberg

*Attorney, Agent, or Firm*—Gail W. Woodward

[57] ABSTRACT

A small voltage is generated in such a manner as to be related to the increment between a pair of semiconductor band gap related voltages. Such a voltage will be linearly related to absolute temperature and will be useful in compensating the temperature dependence of semiconductor integrated circuits. In addition, it will allow control of the gain (or attenuation) of transistor current mirrors to a high degree of precision. The circuit is configured so that the small voltage is controlled by integrated circuit area parameters and thus is readily controllable and reproducible using conventional manufacturing processes.

5 Claims, 7 Drawing Figures

DELTA $V_{BE}$ GENERATOR CIRCUIT

BACKGROUND OF THE INVENTION

The invention is disclosed but not claimed in copending application Ser. No. 798,728 filed May 19, 1977, by Dennis M. Monticelli and Robert S. Sleeth and titled PHOTO ELECTRIC BIASED PHOTO DIODE OPERATIONAL AMPLIFIER.

It has been found that integrated circuits (ICs) tend to be temperature sensitive and many schemes have been devised to cope with the problem. It has also been found that a small potential, on the order of a fraction of a volt and proportional to absolute temperature, is useful in certain IC designs. Previous approaches to generating this potential either did not make use of negative feedback to provide a true voltage source output or have required elaborate circuitry.

SUMMARY OF THE INVENTION

It is an object of the invention to develop a small potential that is linearly related to absolute temperature.

It is a further object of the invention to provide an IC that develops a small potential, the value of which is controlled by circuit area relationships and temperature alone.

These and other objects are achieved by a circuit configuration in which forward biased diodes are operated at substantially different current densities. The output voltage is made equal to the difference between the voltages developed across the forward biased diodes. The magnitude of the voltage can be controlled by the diode current and area characteristics, both of which can be established by area factors in IC design. These are readily controlled in IC manufacturing to a high degree of precision. The output voltage is thus related to the difference between two semiconductor band gap related voltages. It can therefore be made small and controllable and it will be linearly related to absolute temperature.

DESCRIPTION OF THE INVENTION

Figure 1:
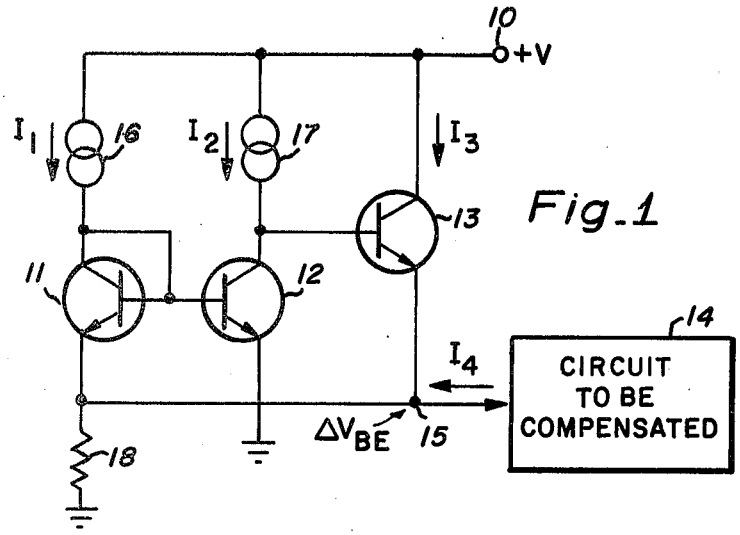
FIG. 1 is a schematic diagram of a simplified version of the invention.

The circuit of FIG. 1 represents a simplified embodiment of the invention. The circuit operates from a power supply labeled +V which applies a potential between terminal 10 and ground. Transistors 11–13 operate to compensate another IC portion labeled 14 by way of an output voltage developed at node 15. The output potential at node 15 is ordinarily regarded as small with respect to the typical potential required between emitter and base of an "on" transistor. As will be shown below this potential varies linearly with absolute temperature.

Transistors 11 and 12 are operated from current sources 16 and 17 which produce $I_1$ and $I_2$ respectively. Transistor 11 is diodeconnected and directly connected to transistor 12 which operates as a common emitter amplifier. Transistor 12 is made to operate at a higher emitter current density than transistor 11 so that the $V_{BE}$ of transistor 12 exceeds that of transistor 11. The difference appears at node 15 across resistor 18. The relation is: $\Delta V_{BE}=V_{BE12}-V_{BE11}$. To achieve a potential at node 15 current sources 16 and 17 can be made to produce equal values of $I_1$ and $I_2$ and the area of transistor 11 made larger than the area of transistor 12. Alternatively transistors 11 and 12 can have the same area and $I_2$ made larger than $I_1$. Furthermore, the area can be ratioed along with the currents if desired.

Transistor 13 acts as a feedback amplifier that stabilizes the circuit and forces the equality noted above. For example, if the voltage at node 15 were to tend to rise, diode-connected transistor 11 would couple the rise to the base of transistor 12. The collector of transistor 12 would fall and this fall would be coupled by way of emitter follower transistor 13 to node 15. Thus, negative feedback is employed using a common emitter-common collector cascade. The actual voltage at node 15 will stabilize at:

$$\Delta V_{BE} = \frac{KT}{Q} \ln\left(\frac{I_2}{I_1} \cdot \frac{A1}{A2}\right) \quad (1)$$

Where:

A1 is the area of transistor 11

A2 is the area of transistor 12

K is Boltzman's constant

T is absolute temperature

Q is the electron charge

This formula shows that the voltage at node 15 will be linearly related to absolute temperature and related to the current density ratio by the natural log. Since KT/Q at room temperature (about 300° Kelvin) is about 26 mv, if the current density ratio is made equal to 100, then the $\alpha V_{BE}$ will be about 120 mv. This value would fall to about 60 mv at 150° Kelvin.

The circuit of FIG. 1 will thus produce a small, less than $V_{BE}$, potential at node 15 that will be used as a bias voltage source for circuit 14. If desired, $I_1$ and $I_2$ could carry AC signal components to greater than 1 MHz in which case node 15 would become both a bias and a signal source. The current flowing in resistor 18 will be the sum of $I_1$, $I_3$ (the current flowing in transistor 13) and $I_4$ (the current flowing in circuit 14). Resistor 18 will be selected to drop the value of $\Delta V_{BE}$ at the current value noted above. This permits the current $I_3$ to be a design variable and permits transistor 13 to operate over that current range required by the operating circuit 14.

From the above it can be seen that the circuit of FIG. 1 will self-adjust, because of the heavy negative feedback, to satisfy or force the equality of equation (1).

The circuit of FIG. 1 is useful in practical form but is not ideal in terms of balance. For example, while $I_1$ flows largely in transistor 11, some small fraction will flow in the base of transistor 12. Also while most of $I_2$ flows in transistor 12, some smaller fraction will flow in the base of transistor 13. As a practical matter the NPN transistors as shown can be made to have current gain or Beta values in excess of 200 in production IC designs. This means that the base currents will be less than 0.5% of the collector current and the unbalance of currents in FIG. 1 will be small.

Figure 2:
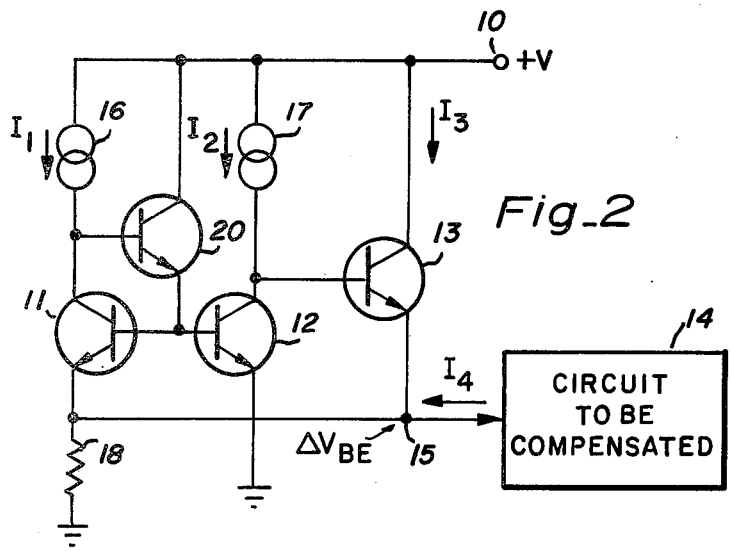
FIG. 2 is a schematic diagram of an improved version of the circuit of FIG. 1.

FIG. 2 is a schematic diagram of an improved circuit which minimizes the effect of unbalance mentioned above. An emitter follower transistor 20 is used to couple the collector of transistor 11 to its base. The current flowing in the base of transistor 20 will equal $(I_1+I_2/\text{Beta})^2$. Thus the square of transistor Beta is invoked and for the above Beta value of 200 the percent unbalance is down to much less than 0.5%.

Figure 3:
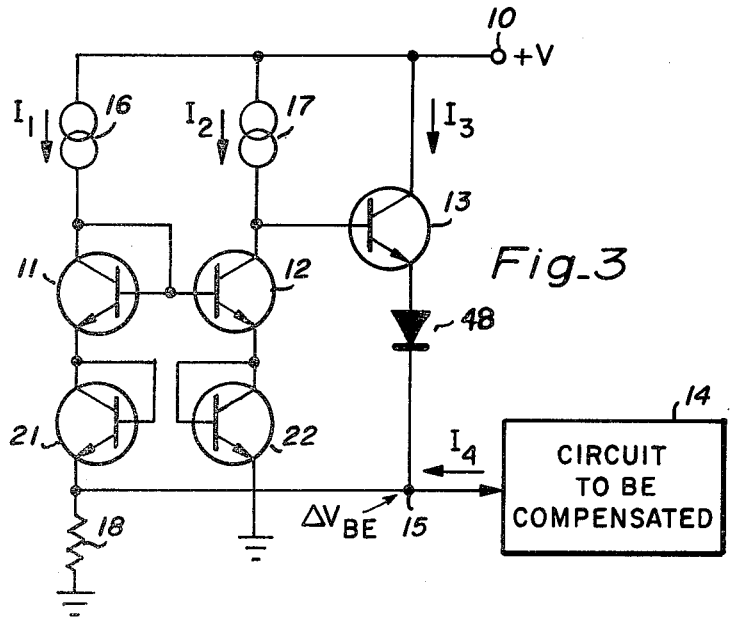
FIG. 3 is a schematic diagram of an embodiment of the invention that produces a higher voltage than that of the FIG. 1 embodiment.

FIG. 3 is a schematic diagram of a circuit designed to produce larger values of $\Delta V_{BE}$. Diode-connected transistors 21 and 22 have been added in series with transistors 11 and 12 respectively of FIG. 1. Also, diode 48 was added for level shift purposes to restore the $V_{CE}$ potential of 12 to approximately a $V_{BE}$. For this circuit the voltage at node 15 will stabilize at:

$$\Delta V_{BE} = \frac{KT}{Q} \ln \left[ \frac{A1}{A2} \cdot \frac{A3}{A4} \cdot \left(\frac{I_2}{I_2}\right)^2 \right] \quad (2)$$

where:

A3 is the area of transistor 21

A4 is the area of transistor 22.

Note that the value of $\Delta V_{BE}$ is related to the square of the current ratio. For the previous current and transistor area ratios of 10:1 the circuit of FIG. 3 would produce a $\Delta V_{BE}$ of about 240 mv. at 300° Kelvin. While a higher voltage is present the value becomes more critically dependent upon the values of $I_1$ and $I_2$ produced by sources 16 and 17, thus making their design more critical.

Figure 4:
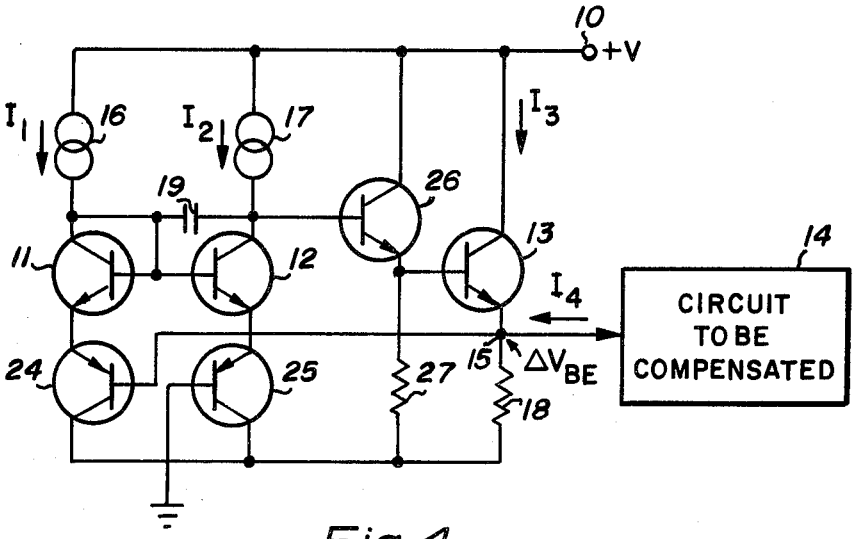
FIG. 4 is a schematic diagram of a balanced embodiment to the circuit of FIG. 3.

FIG. 4 is a schematic diagram of an alternative embodiment to that of FIG. 3 that is fully balanced. This circuit employs complementary transistors to achieve similar performance. The emitter collector circuit of transistor 24 operates in series with transistor 11 and diode-connected transistor 25 is connected in series with transistor 12. An additional emitter follower transistor 26 is added to increase the gain of the feedback loop. A further feature of 26 is to more accurately define (via 27) the base current loss at the collector of 12 to be the same percentage of $I_2$ as the base current loss at the collector of 11 is to $I_1$. The level shift provided by 26 further enhances balance by approximately equalizing the potentials at the collectors of 11 and 12. The base of transistor 24 is returned to node 15 so that the base of transistor 11 operates at $\Delta V_{BE}+2V_{BE}$ drops above ground as did the circuit of FIG. 3. Also, the circuit of FIG. 4 operates in accord with equation (2). It will be noted that in FIG. 4 the current flowing in resistor 18 is substantially equal to the sum of $I_3$ and $I_4$. The value of resistor 27 (calculated for current balance) will be established at value:

$$R_{27} = \frac{I_1 (V_{BE} + \Delta V_{BE})}{I_2 (I_1 + I_2)}$$

Capacitor 19 is present to frequency compensate the circuit to have reduced gain at higher frequencies.

Figure 5:
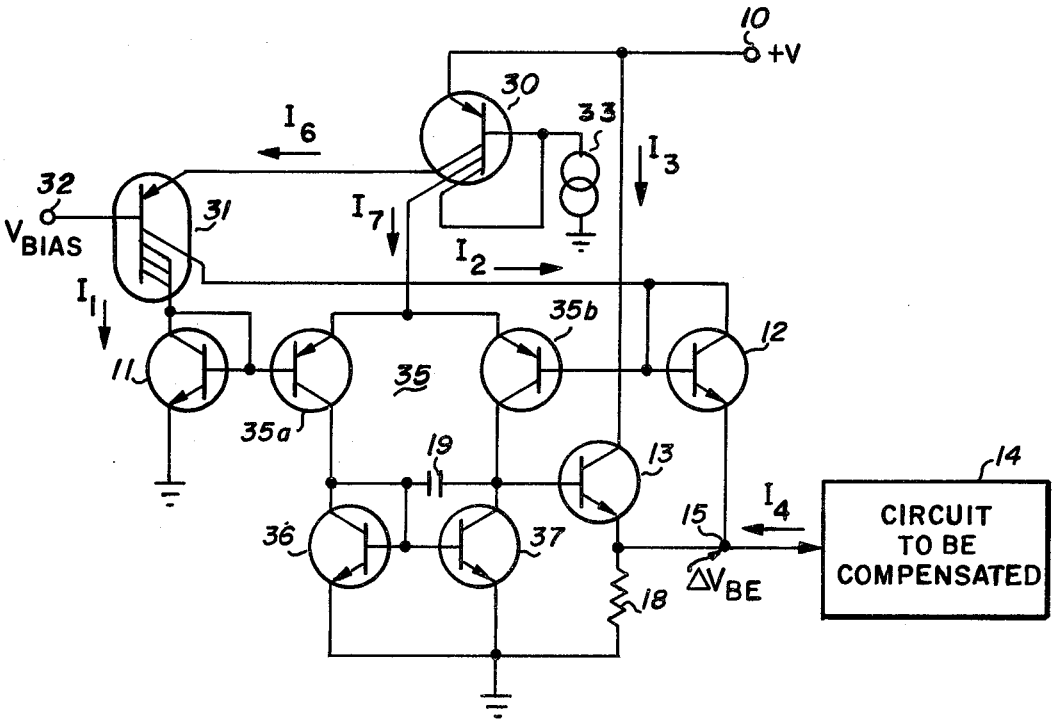
FIG. 5 is a schematic diagram of an alternative balanced embodiment of the invention.

FIG. 5 is a schematic diagram of an alternative fully balanced embodiment using complementary transistors in an IC amenable configuration. As before, transistors 11 and 12 (both diode connected) are supplied with currents $I_1$ and $I_2$ respectively, suitably ratioed by the collector area ratio of transistor 31. While the schematic shows an area ratio of three, this is only intended to show the larger of the two collector areas. Actually any selected area ratio could be used. The base of transistor 31 is supplied with a constant voltage bias at terminal 32 to set the device operation point. Multiple collector transistor 30, which may include three equal sized collectors, is designed to supply $I_6$ to transistor 31 and $I_7$ to differential amplifier 35. The value of $I_7$, which equals $I_6$, is set by current source 33. Since the three collectors are the same size, all of the collector currents will be equal. Transistors **35*a* and 35*b* have their bases coupled to diode-connected transistors 11 and 12 respectively. Transistors 36 and 37 constitute an active load for differential amplifier 35 and the single-ended output is coupled to the base of the emitter follower 13 which feeds the output back to the inverting input (by way of transistor 12) to complete the negative feedback loop. The current through 13 is adjusted via resistor 18 to provide a base current loss at the collector of 37 to balance the base current loss at 36. Using this configuration, the differential amplifier will drive the base of transistor 35*b* to very close to the potential at the base of transistor 35*a*. This will force the voltage across transistor 11 into equality with the sum of $\Delta V_{BE}$ and the voltage across transistor 12. This equality is forced while still having separate current sources for the two diode-connected transistors. Capacitor 19** is present to frequency compensate the circuit to have reduced gain at higher frequencies.

Figure 6:
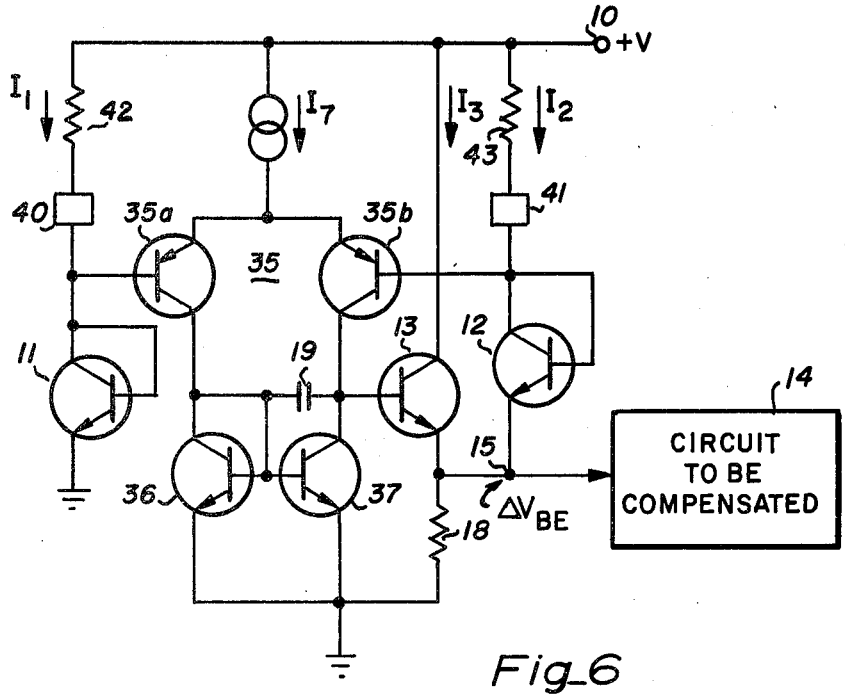
FIG. 6 is a schematic diagram of a programmable balanced embodiment of the invention.

FIG. 6 is a schematic diagram showing an alternative circuit to that of FIG. 5. However, in FIG. 6 the diode currents can be programmed by external current sources. Differential amplifier 35 has its two input terminals connected to IC pads 40 and 41. This permits resistors 42 and 43 to supply currents $I_1$ and $I_2$ respectively to set the diode-connected transistor current ratio. Since these resistors 42 and 43 are available externally, the user of the IC can program any desired current ratio and thus set his own selected value of $\Delta V_{BE}$ at node 15. These resistors can also be replaced by any suitable current sources. Note that since $\Delta V_{BE}$ is proportional to the ratio of currents, a multiplier function is established. External control of these currents allows modulation of the $\Delta V_{BE}$ output.

Figure 7:
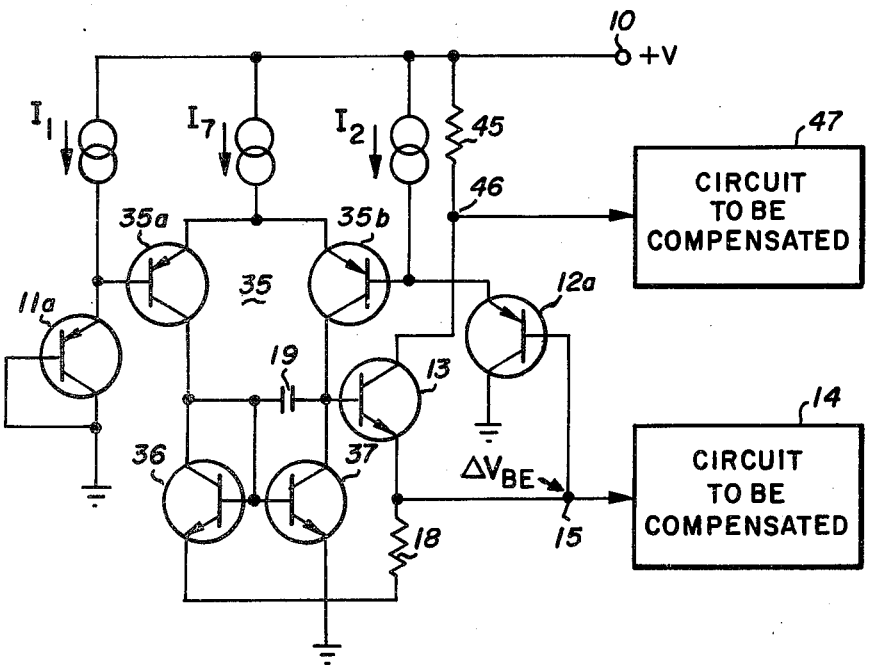
FIG. 7 is a schematic diagram of a circuit having two polarities of output potential available.

FIG. 7 is a schematic diagram of yet another fully balanced circuit. The circuit is configured much as that of FIG. 6. However, transistors **11*a* and 12*a* are PNP transistors and the collector of transistor 12*a* is coupled to ground thereby converting it from an inactive diode to an emitter follower in the feedback loop. Since the emitter-base circuit of transistor 12*a* is still coupled in series with $\Delta V_{BE}$ to ground, the negative feedback loop around differential amplifier 35 will force the equality expressed in equation (1). An additional resistor 45 is coupled into the collector of transistor 13 so that it carries the same current as resistor 18. If resistor 45 is the same value as resistor 18, node 46 will operate at $\Delta V_{BE}$ below +V. Thus an opposite polarity potential operating below the supply potential is available for compensating another circuit indicated generally as 47. The circuit of FIG. 7 can be used to compensate either or both of circuits 14 and 47. The addition of a resistor in series with the collector of transistor 13 in FIG. 4 would provide the same complementary output. With both circuits, accurate tracking of the ground referenced output depends on the loading effect of circuits 14 and 47**.

The $\Delta V_{BE}$ compensating circuit has been disclosed in terms of a number of different configurations. Clearly, there are still other alternatives and equivalents. Accordingly, it is intended that the scope of the invention be limited only by the following claims.

I claim:

1. A circuit for generating a compensating potential that is small with respect to a $V_{BE}$ potential of an "on" transistor and is linearly proportional to absolute temperature, said circuit comprising:

a first branch including first diode means coupled in series with means for developing said compensating potential and first current supply means;

a second branch including second diode means coupled in series with second current supply means;

said first and second current supply means being operated in conjunction with said first and second diode means to establish a predetermined current density ratio in said first and second diode means with said second diode means operating at a higher current density;

means for coupling said first branch to said second branch to force the potential developed across said second diode means to equal the potential developed across the series combination of said first diode means and said means for developing said compensating potential; and amplifier means having an input coupled to said second branch and an output coupled directly to said means for developing said compensating potential, said amplifier means being operated in a negative feedback mode to force said compensating potential to equal the difference in potential between said first and second diode means whereby said predetermined current density ratio is maintained constant.

2. A circuit for generating a compensating potential that is small with respect to a $V_{BE}$ of an on transistor and is linearly proportional to absolute temperature, said circuit comprising:

a first branch including first diode means coupled in series with means for developing said compensating potential and first current supply means, said first current supply operating to develop a current in said first diode means at a first current density;

a second branch including second diode means coupled in series with second current supply means, said second current supply means operating to produce a current in said second diode means at a second current density that is higher than said first current density; and differential amplifier means having an output coupled directly to said means for developing said compensating potential and a pair of input terminals each coupled to a respective one of said first and second branches, said amplifier means being operated to maintain the ratio of said first current density to said second current density constant.

3. The circuit of claim 2 wherein said first branch and said second branch are operated from independent current sources.

4. The circuit of claim 2 wherein said first branch and said second branch are operated from a common current source having a pair of output current terminals.

5. The circuit of claim 4 wherein said common current source includes means for ratioing the currents flowing in said pair of output terminals.

* * * * *